US007438198B2

(12) United States Patent
Pickles

(10) Patent No.: US 7,438,198 B2
(45) Date of Patent: Oct. 21, 2008

(54) TAMPER EVIDENT CONTAINER-LID COMBINATION

(75) Inventor: Michael Pickles, Leeds (GB)

(73) Assignee: Really Useful Boxes Inc., Elk Grove Village, IL (US)

( * ) Notice: Subject to any disclaimer, the term of this patent is extended or adjusted under 35 U.S.C. 154(b) by 44 days.

(21) Appl. No.: 11/415,829

(22) Filed: May 2, 2006

(65) Prior Publication Data

US 2006/0201947 A1 Sep. 14, 2006

Related U.S. Application Data

(63) Continuation of application No. 10/332,907, filed as application No. PCT/GB01/03108 on Jul. 13, 2001, now Pat. No. 7,159,733.

(30) Foreign Application Priority Data

Jul. 14, 2000 (GB) ..... 0017225.4

(51) Int. Cl.

| | |
|---|---|
| ***B65D 43/02*** | (2006.01) |
| ***B65D 55/06*** | (2006.01) |
| ***B65D 45/16*** | (2006.01) |
| *B65D 55/10* | (2006.01) |

(52) U.S. Cl. ..... 220/324; 220/315; 220/318; 220/326; 220/756

(58) Field of Classification Search ..... 220/324, 220/315, 318, 265, 266, 756, 326
See application file for complete search history.

(56) References Cited

U.S. PATENT DOCUMENTS 3,546,752 A * 12/1970 Sargent ..... 220/324
4,610,371 A * 9/1986 Karkiewicz ..... 220/266
4,621,744 A 11/1986 Foster
4,625,885 A 12/1986 Nichols
4,658,980 A 4/1987 Lindstrom
4,711,363 A 12/1987 Marino (Continued)

FOREIGN PATENT DOCUMENTS

CA 2019225 12/1992

(Continued)

OTHER PUBLICATIONS

International Search Report for PCT/GB01/03108, Oct. 26, 2001.

*Primary Examiner*—Anthony D Stashick
*Assistant Examiner*—Niki M. Eloshway
(74) *Attorney, Agent, or Firm*—Myers Bigel Sibley & Sajovec

(57) ABSTRACT

A container comprises a body portion, a lid portion and, mounted on one of the body portion and the lid portion, a locking member. The locking member is movable from an unlocking position to a locking position in which it engages the other of the body portion and the lid portion to hold the lid in engagement with the body portion. The container is provided with a sealing means including a sealing member which extends between the locking member and other of the body portion and the lid portion when the locking member is in its locking position. Movement of the locking member from the locking to the unlocking position is only possible if the sealing member is rendered ineffective for further sealing use.

23 Claims, 3 Drawing Sheets

U.S. PATENT DOCUMENTS

| | | | | | |
|---|---|---|---|---|---|
| 4,725,830 | A | * | 2/1988 | Kawai et al. | 345/160 |
| 4,782,977 | A | | 11/1988 | Watanabe et al. | |
| 4,820,499 | A | | 4/1989 | Taschner | |
| 4,915,913 | A | | 4/1990 | Williams et al. | |
| 5,133,470 | A | | 7/1992 | Abrams et al. | |
| 5,382,528 | A | * | 1/1995 | Scoville | 436/1 |
| 5,462,183 | A | * | 10/1995 | Rohr et al. | 215/237 |
| 5,695,087 | A | * | 12/1997 | Tutton et al. | 220/324 |
| 5,725,830 | A | | 3/1998 | Taschner | |
| 5,893,475 | A | | 4/1999 | May | |
| 5,931,291 | A | * | 8/1999 | Sedon et al. | 206/1.5 |
| 5,979,691 | A | * | 11/1999 | Von Holdt | 220/266 |
| 6,206,189 | B1 | * | 3/2001 | Huot et al. | 206/379 |
| 6,328,355 | B1 | | 12/2001 | Bortz | |
| 6,347,716 | B1 | * | 2/2002 | Nofer et al. | 215/235 |
| 6,439,625 | B1 | | 8/2002 | Schainholz et al. | |
| 7,021,482 | B2 | * | 4/2006 | Solowiejko | 220/254.2 |
| 7,159,733 | B2 | * | 1/2007 | Pickles | 220/324 |
| 2003/0085227 | A1 | * | 5/2003 | Azzarello | 220/266 |

FOREIGN PATENT DOCUMENTS

| | | | |
|---|---|---|---|
| DE | 64679 | C | 9/1891 |
| DE | 2832069 | A | 1/1980 |
| GB | 562291 | | 6/1944 |
| GB | 595744 | | 12/1947 |

* cited by examiner

TAMPER EVIDENT CONTAINER-LID COMBINATION

RELATED APPLICATION INFORMATION

This application is a continuation of U.S. patent application Ser. No. 10/332,907 filed Oct. 2, 2003, now U.S. Pat. No. 7,159,733 which is a 35 U.S.C. § 371 national phase application of PCT Application No. PCT/GB01/03108, having an international filing date of Jul. 13, 2001, and claiming priority to GB 0017225.4, filed Jul. 14, 2000, the disclosures of which are incorporated by reference herein in their entireties.

FIELD OF THE INVENTION

The present invention relates to containers for storing and transporting articles and, more specifically to a tamper-evident and/or sealed container and lid combination. A tamper-evident container is one which may be opened (with some difficulty), although evidence of the intrusion is apparent. A sealed container is rendered more difficult to open as a result of the seal, again evidence of such intrusion is made apparent. As used herein, the terms 'tamper-evident', 'sealed' or 'seal' are interchangeable, wherein a 'tamper-evident' container may also refer to a 'sealed' container.

BACKGROUND TO THE INVENTION

Portable plastic storage containers are well known consumer and industrial products and provide important advantages in terms of strength and light weight compared to containers made of other materials. They are used for a variety of storage and transporting needs such as document files, work tools or other household articles.

A known storage container comprises a four-sided base, a lid covering the base and one or more carrying handles. The handles are often located at the ends of the base and are integral therewith. A locking member is pivotally attached to the base and pivots up and over the peripheral rim of the lid to secure the lid to the base.

Such a container affords no protection in terms of security, whereby any tampering with the container can be easily identified. This feature may be of particular importance when the container is used, by way of example, for holding files or documents of a confidential nature. Alternatively a tamper-evident container may be required to hold food and beverages wherein the risk of contamination of the contents during storage and transport of the container can be eliminated. Goods in transit such as books, clothes and other general goods may also be held within such a container.

Canadian Patent No. 2,019,225 describes a square tamper-evident closure and container combination incorporating means to provide a visual indication of the removal of the closure. The container comprises a peripherally extending flange with weakened corners which breaks when the closure is removed. The disadvantage of this arrangement is that once the flange has been broken, the container cannot be re-used.

Containers are also known which are provided with a replaceable security seal which extends through the lid and side wall of an attached lid container. The disadvantage of this arrangement is that detachment of the seal proves very difficult without the aid of a suitable mechanical device and/or the application of mechanical force. Whilst this feature may serve as a deterrent to the unauthorised user, the legitimate consumer often regards this as time-consuming and inefficient and could result in damaging the lid or base.

There is a need for a container which addresses the problem of tamper evidence, is re-usable and allows easy authorised access.

STATEMENTS OF THE INVENTION

According to the present invention, there is provided a container comprising a body portion, a lid portion and, mounted on one of the body portion and the lid portion, a locking member which is movable from an unlocking position to a locking position in which it engages the other of the body portion and the lid portion to hold the lid in engagement with the body portion, the container also being provided with sealing means including a sealing member which extends between said locking member and said other of the body portion and the lid portion when the locking member is in its locking position, movement of the locking member from the locking to the unlocking position only being possible if the sealing member is rendered ineffective for further sealing use.

In one embodiment of the invention, the locking member is integral with either the body portion or the lid portion upon which it is mounted. In one embodiment the locking member is permanently attached to the body portion or the lid portion upon which it is mounted. Preferably the locking member is removable from the body portion or the lid portion upon which it is mounted.

The invention also therefore also provides for a locking member wherein said locking member is adapted for mounting on one of the body or lid portion of a container and which when in use is movable from an unlocking position to a locking position in which it engages the other of the body portion and the lid portion to hold the lid in engagement with the body portion. The locking member comprises sealing means including a tamper evident pin or peg and characterised in that the tamper evident pin or peg extends between said locking member and said other of the body portion and the lid portion when the locking member is in its locking position, movement of the locking member from the locking to the unlocking position causing breakage of the tamper evident pin or peg which is rendered ineffective for further sealing use.

Preferably the locking member is mounted on the body portion of the container. Preferably the body portion comprises two side walls and two end walls. Most preferably a locking member is mounted on each end wall of the body portion of the container.

Preferably the locking member is pivotally attached to the body portion of the container.

Preferably the body portion and lid of the container are made of plastics material. Any known method of manufacturing the container and lid can be used, the preferable method of manufacture being injection moulding whereby the container is moulded in one piece and typically made of a polymer such as polypropylene or polyethylene.

Preferably the body of the container is provided with reinforcing rib structures. More preferably the reinforcing ribs provided on the end walls of the container are provided with apertures.

Preferably the locking member comprises a body portion, an intermediate portion and attachment means.

Preferably the attachment means of the locking member are pivotally attached through the apertures provided on the end walls of the container.

In one embodiment, the sealing means is integral with at least one of the locking member, body portion and the lid portion. Preferably the sealing means is provided separately.

Preferably the sealing member extends between the locking member and at least one of the body portion and the lid portion when the locking member is in its locking position by means of apertures provided in the locking member and at least one of the body portion and lid portion.

Preferably the sealing member comprises a pin with a body portion and arm portion and base portion.

Preferably the sealing member is made of plastics material. Preferably the arms are joined to the body portion by a frangible connection. In an alternative embodiment of the invention, the body portion of the sealing member is joined to base portion by a frangible connection. Preferably the movement of the locking member from the locking to the unlocking position breaks the frangible connection.

This container is an improvement over the prior art container in that the movement of the locking member from the locking to the unlocking position causes the seal to be broken. Access to the container is therefore achieved without the aid of mechanical means or manual force. The container can be re-sealed by the use of a new sealing member.

In an alternative embodiment the sealing member is made of suitable plastics material e.g., polycarbonate or polyamide, such that movement of the locking member from the locking to the unlocking position is not sufficient to break the sealing member. Mechanical means are required to gain access to the container. The container can be re-sealed by the use of a new sealing member. This container is an improvement over the conventional container in that the sealing member is positioned such that it extends between the locking member and another part of the container. This provides easy access for its removal by mechanical means. Preferably the sealing member extends substantially horizontally between the locking member and the other part of the container.

Preferably the sealing means is suitably marked e.g., colour coded or provided with data such as an actual date, a number or letter sequence.

DETAILED DESCRIPTION OF A PREFERRED EMBODIMENT

A preferred embodiment will now be described by way of example only and with reference to the accompanying drawings.

Figure 1:
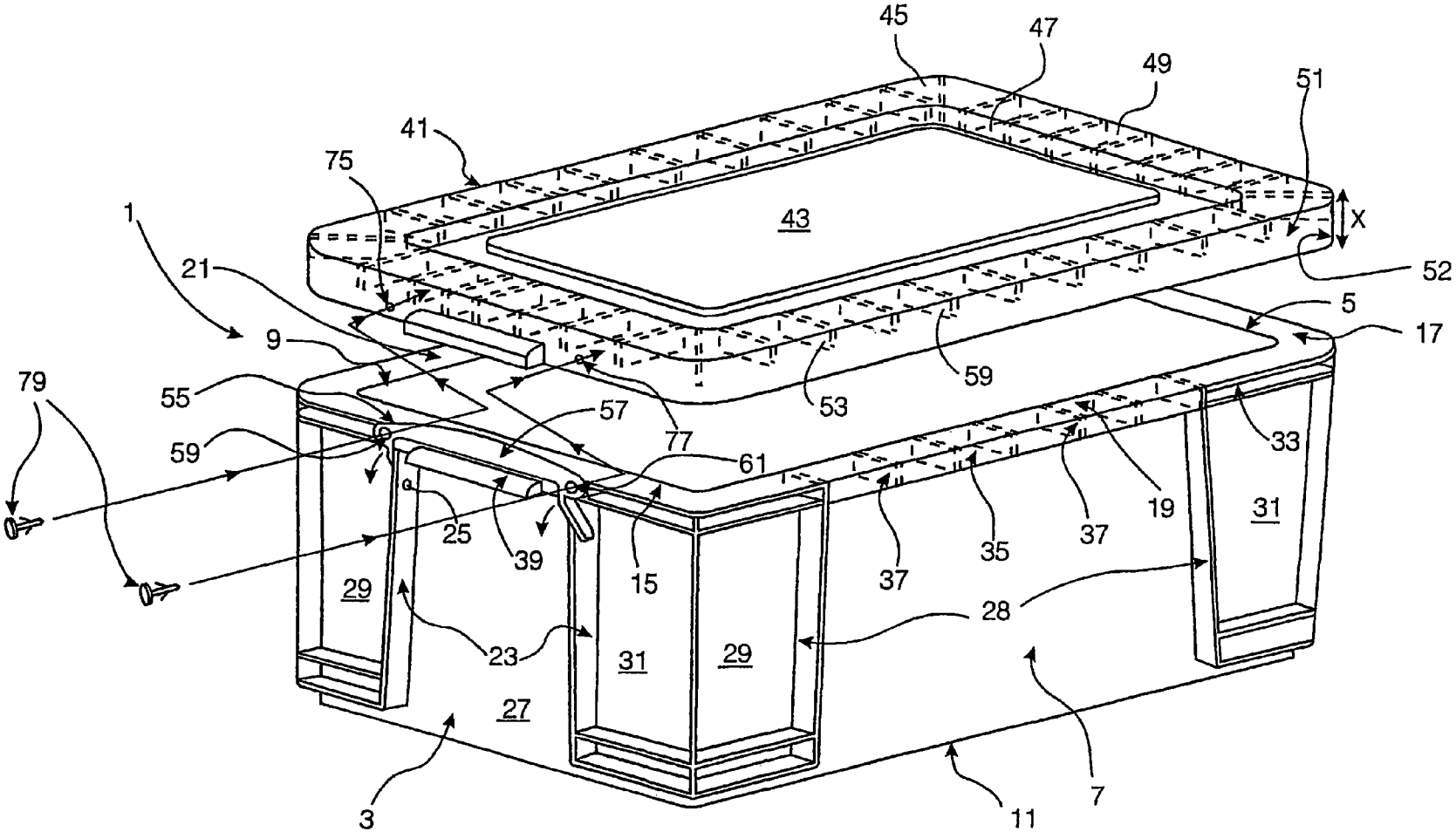
FIG. 1 is a diagrammatic perspective view of a container in accordance with the present invention.
Figure 2:
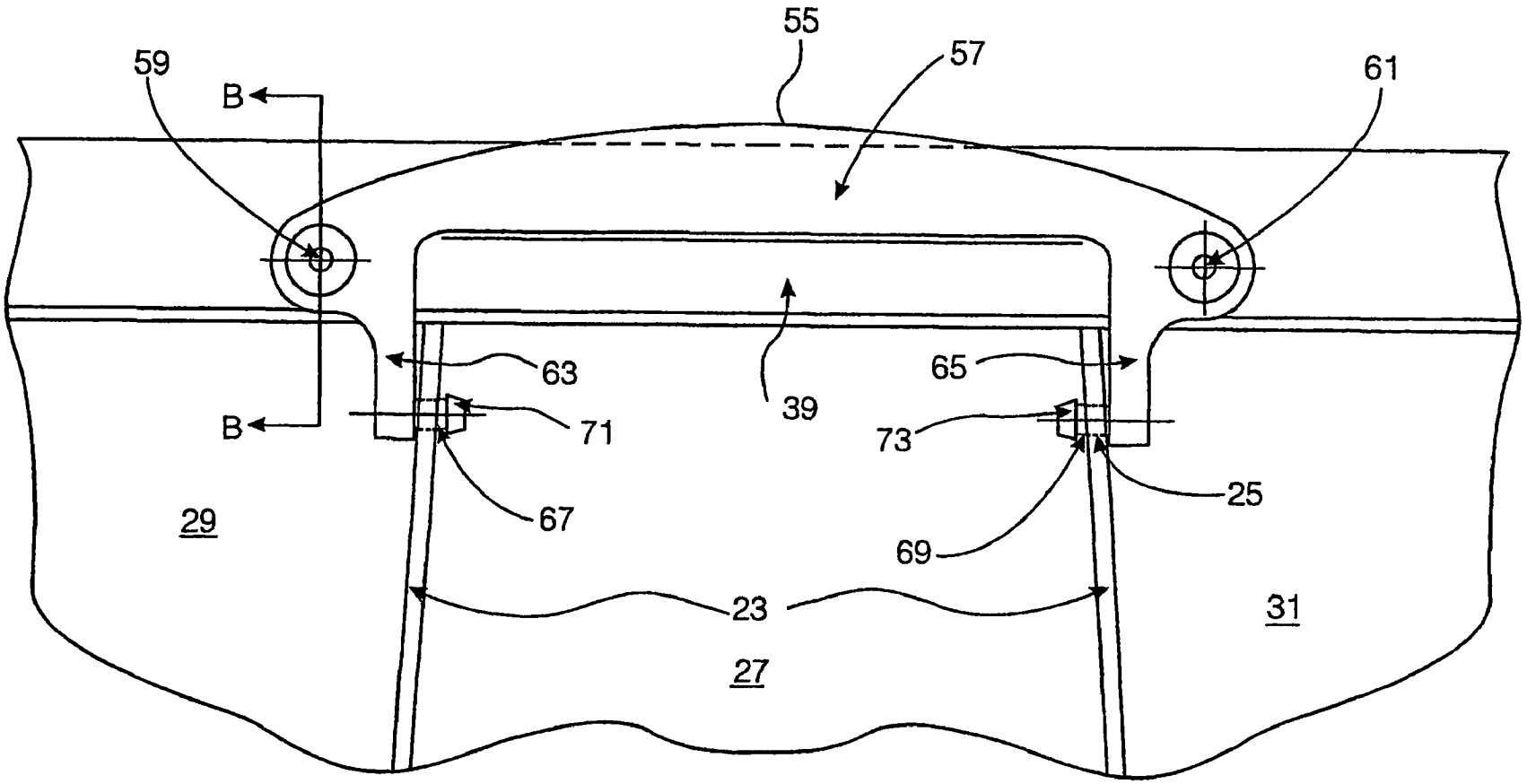
FIG. 2 is a diagrammatic front elevation of a container in accordance with the present invention.

Referring to FIGS. 1 and 2, a container, generally denoted 1, comprises opposite end walls 3 and 5, and opposite side walls 7 and 9, which are integrally joined in one piece to form a continuous rectangular vertical wall and which are arranged substantially at right angles to one another and to integral base member 11.

Preferably the container is moulded in one piece by injection moulding and made of polyproplyene or polyethylene.

It will be understood that although end walls 3 and 5 and side walls 7 and 9 are preferably vertical, the walls of container 1 manufactured by injection moulding will necessarily have a small mould taper.

The upper edge portions of end walls 3 and 5 and side walls 7 and 9 include outwardly extending horizontal flange 13, connected together around substantially the entire upper periphery of the container to constitute end flanges 15 and 17 and side flanges 19 and 21.

Each end wall 3 and 5 and each side wall 7 and 9 is additionally provided with two outwardly extending reinforcing ribs 23. Ribs 23 extend vertically from the lower edge portion of each end wall 3 and 5 and side walls 7 and 9 adjacent to base member 5, to the upper edge of each end wall 3 and 5 and side wall 7 and 9. Ribs 23 meet flush with the respective horizontal flange 15, 17, 19 and 21 in the upper edge portion. Each reinforcing rib 23 on end walls 3 and 5 is provided with an aperture 25 which is positioned at an equidistant location from the uppermost edge of the end wall.

Ribs 23 serve to divide each end wall 3 and 5 and side wall 7 and 9 into a central portion 27 and outer portions 29 and 31. The upper edge portions of each outer portion 29 and 31 include a second outwardly extending horizontal flange 33 which underlies horizontal flange 13 in these portions, running parallel thereto.

Those sections of horizontal flange 19 and 21 in the central portion of each side wall 7 and 9 are provided with downwardly depending flange 35 forming an inverted 'L'-shape feature.

The uppermost region of the respective side wall and inverted 'L' comprise an inverted, straight sided channel-feature. The inverted 'L' feature is held in place away from the outside surface of side walls 7 and 9 by means of a plurality of square shaped reinforcing webs 37. Reinforcing webs 37 are of a corresponding size to the cross-section of the inverted, straight sided channel and sit snugly inside the inverted channel, positioned at equidistant intervals therealong.

A downwardly depending flange extends from those sections of horizontal flanges 15 and 17 in the central portion of each end wall 3 and 5 and is moulded into the shape of a handle 39. Handle 39 projects outwardly from the respective end wall, thus providing adequate clearance from each end wall 3 and 5 for the user to place his/her fingers in the space defined by the clearance and with his/her thumb positioned above the handle bar, to achieve a secure grip on the handle and transport the box from one location to another. It will be appreciated that the channel feature formed by horizontal flanges 19 and 21 in the central portion of each side wall 7 and 9 and downwardly depending flange 35 may also be used to transport the container, whereby the inverted channel and webs 37 are used to secure a firm grip on the container.

Container 1 is adapted to receive a removable lid 41 which is preferably moulded in one piece from a synthetic resin, for example, polypropylene or polyethylene and preferably the same material as the base. Lid 41 is of rectangular shape with smoothed cornices and is of a size to close the open top of container 1.

Lid 41 comprises a body portion 43 and peripheral edge 45. The peripheral edge 45 of lid 41 has an inverted U-shape and comprises upwardly extending leg 47, ledge 49 which extends horizontally therefrom and substantially downwardly extending leg 51. Downwardly extending leg 51 terminates at end 52 to project from horizontal ledge 49 of lid 41 below the plane of the main body portion of lid 41 (See FIG. 3).

Reinforcing rectangular shaped webs 53 are provided at various intervals around the periphery of the lid within the space defined by upwardly extending leg 47, horizontally extending ledge 49 and the uppermost portion of downwardly extending leg 51.

The peripheral edge 45 of lid 41 is adapted to fit over outwardly extending horizontal flange 13 and second, underlying horizontal flange 33 running parallel thereto, such that end 52 of downwardly extending leg 51 meets flush with the outermost edge of second, underlying horizontal flange 33.

With particular reference to FIG. 2, removable locking member 55 includes a body portion which itself comprises elongate bar 57, each end thereof being provided with apertures 59 and 61 and integrally associated with intermediate portions 63 and 65 from which male attachment means 67 and 69 extend. In an alternative embodiment of the invention, locking member 55 is integrally moulded with container 1.

When in use, each male attachment member 67 and 69 of locking member 55 is inserted into a respective aperture 25 located on each reinforcing rib 23 of end walls 3 and 5. Locking member 55 can now pivot freely about a line parallel to the upper edge of the container. Lateral movement of the locking member is prevented by the presence of portions 71 and 73 which are of greater cross-section than that of the aperture provided in reinforcing ribs 23.

Lid 41 is then positioned over container 1 and flange 49 overlies flange 13 of the container. Downwardly depending flange 51 of lid 41 meets flush with the outermost edge of flange 33.

To enable the removable lid to be clamped on the container, a locking member 55 provided on each end wall 3 and 5 of the container and pivotally attached to each reinforcing rib 23 located thereon, is pivoted upwardly from a first unlocking position to a second position whereby each locking member 55 engages the lid portion 41 and holds the lid in engagement with the body portion.

Figure 3:
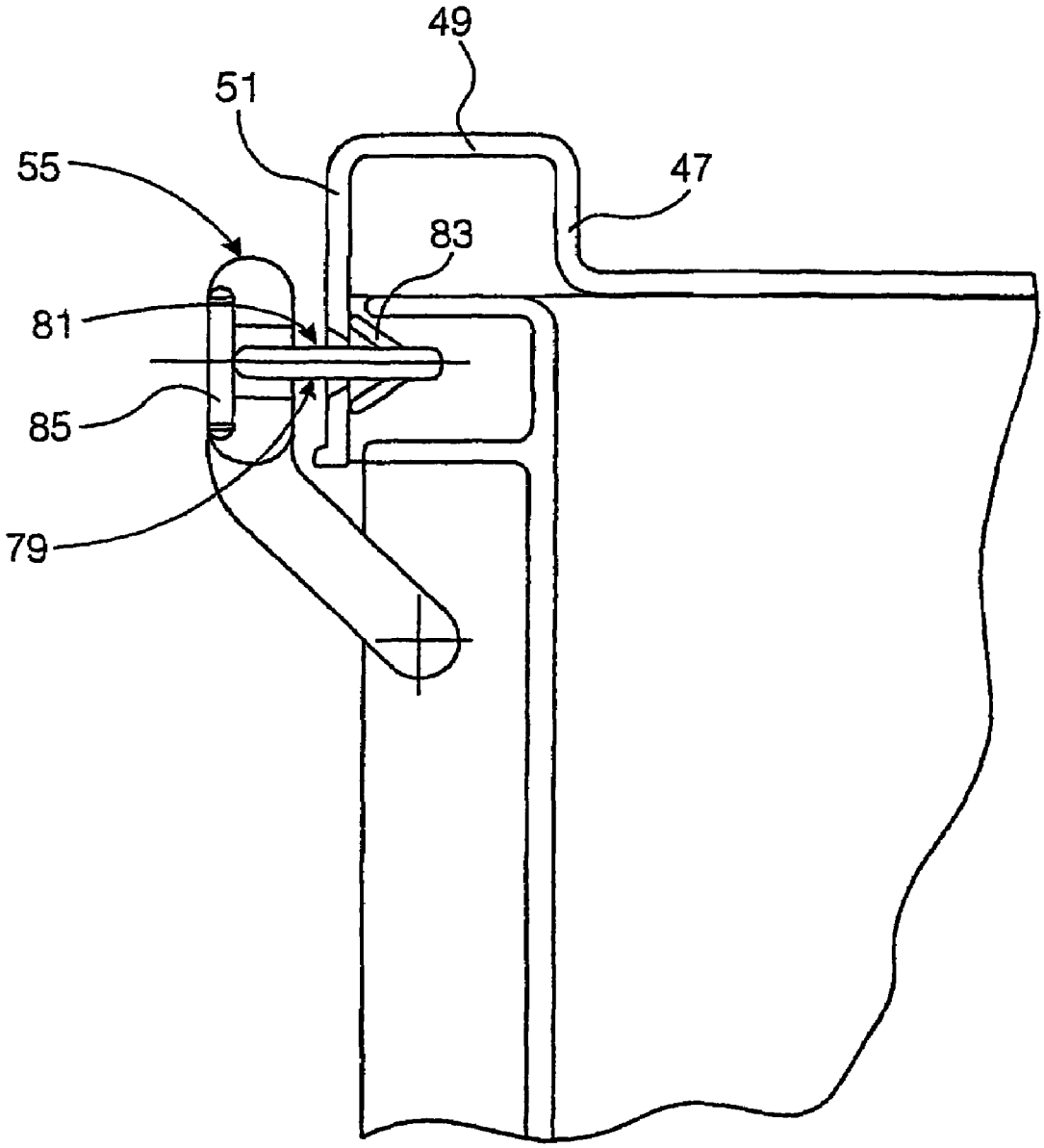
FIG. 3 represents a section of the container viewed along line B of FIG. 2.

Each corner of the main body portion of the locking bar is provided with an aperture 59 and 61. Downwardly extending flange 51 of the peripheral rim 45 of lid 41 is similarly provided with apertures 75 and 77, such that when the locking bar has been pivoted upwardly towards the peripheral rim of the lid, there is provided a continuous passage through the aperture in the locking bar and the downwardly extending flange such that sealing means in the form of a tamper evident pin or peg 79 can be inserted therein. FIG. 3 illustrates this juxtaposition of parts in more detail.

The skilled artisan will appreciate that a tamper evident pin may comprise any of a variety of shapes and configurations. In a preferred embodiment, the tamper evident pin 79 comprises body portion 81, arm portions 83 and base portion 85. In one embodiment of the invention, arm portions 83 are joined to body portion 81 by a frangible connection. In an alternative embodiment of the invention, body portion 81 is joined to base portion 85 by a frangible connection.

When in use, a pin 79 is inserted through each passage provided by each aperture in each locking bar 55 and downwardly depending flange 51. The pin is manufactured from any suitable material, e.g., polystyrene, such that upon insertion of the pin through each aperture, the arm portion retracts towards the body portion. Once the pin has been passed through each aperture, the arms are allowed to expand outwardly and sit, along with the head portion, within the area defined by horizontal flange 13 of container 1 and second horizontal flange 33. FIG. 3 illustrates the inter-relationship between a locking and sealing member of the invention. Body portion 81 of tamper-evident pin 79 extends between apertures 59 and 61 provided in the locking member and downwardly depending flange 51 of lid 41.

In order to gain access to the contents of the container, locking member 55 must be pivoted from the second, upright position, whereby the body and lid of the container are held in engagement, to the first, unlocked position. The nature of the tamper evident seal is such that movement of the locking bar from said locking to said unlocking position will cause breakage of the frangible regions within the pin. The pin is now rendered ineffective for further sealing use and must be replaced before the box can be sealed again. In this way the invention provides a tamper evident sealing arrangement whereby any illegitimate interference with a container can be easily identified.

In an alternative embodiment of the invention the sealing means comprises a pin or peg wherein the base and arm portions are rigidly secured to the body portion and cannot be broken off.

The pin is inserted through the passage provided by each aperture in locking bar 55 and downwardly depending flange 51. Upon insertion of the pin through each aperture, the arm portion retracts towards the body portion. Once the pin has been passed through each aperture, the arms are allowed to expand outwardly and sit, along with the head portion, within the area defined by horizontal flange 13 of container 1 and second horizontal flange 33. The body portion of the pin extends between the apertures provided in the locking member and downwardly depending flange 51 of the lid 41.

The arm and base portions are rigidly connected to the body portion thereby preventing movement of the locking member from the locked position to the unlocked position and forming a permanent seal which cannot be broken manually.

In an alternative embodiment of the invention, the sealing member is integrally associated with the locking member. The advantage of providing the sealing member as a separate member as shown is that this is the only member which needs to be replaced.

To minimise the possibility that the trespasser might, in an effort to cover his tracks, replace the used sealing member with another of the same type, in one embodiment of the invention a portion of the sealing member e.g., the base or body portion, is marked using a suitable marking technique, with, by way of example, the date of purchase of the sealing member. Alternatively the sealing member may be colour coded or marked with a particular company logo, name or password. The user will be comforted by the knowledge that even if the intruder is a 'professional' and the used sealing member is replaced, any tampering is still evident since the third party would be very unlikely to have access to a pin or peg which has been colour/date coded or marked in a particular way.

That which is claimed:

1. A container comprising:

a body portion;

a lid portion configured to engage with the body portion;

a locking member mounted on one of the body portion and the lid portion, the locking member being movable from an unlocking position to a locking position in which it engages the other of the body portion and the lid portion to hold the lid in engagement with the body portion; and a sealing member that extends between the locking member and the other of the body portion and the lid portion when the locking member is in its locking position, wherein movement of the locking member from the locking to the unlocking position causes breakage of the sealing member, which is rendered ineffective for further sealing use;

wherein the sealing member extends through the locking member and the other of the body portion and the lid portion when the locking member is in its locking position.

2. A container according to claim 1, wherein the locking member is mounted on the body portion, the body portion includes at least one vertical sidewall and the sealing member extends perpendicular to the at least one vertical sidewall.

3. A container according to claim 1, wherein the locking member is mounted on the lid portion, the lid portion includes at least one vertical sidewall and the sealing member extends perpendicular to the at least one vertical sidewall.

4. A container according to claim 1 wherein the locking member is integral with either the body portion or the lid portion upon which it is mounted.

5. A container according to claim 1 wherein the locking member is permanently attached to the body portion or the lid portion upon which it is mounted.

6. A container according to claim 1 wherein the locking member is removable from the body portion or the lid portion upon which it is mounted.

7. A container according to claim 1 wherein the locking member is pivotally attached to the body portion or the lid portion of the container.

8. A container according to claim 1 wherein the locking member is mounted on the body portion of the container.

9. A container according to claim 8 wherein the body portion of the container comprises two side walls and two end walls and the locking member is mounted on at least one end wall of the body portion of the container.

10. A container according to claim 9 wherein the locking member comprises a body portion, an intermediate portion and attachment means.

11. A container according to claim 10 wherein the attachment means of the locking member are pivotally attached through apertures provided on the end wall of the container.

12. A container according to claim 1 wherein the sealing member is integral with at least one of the locking member, body portion and the lid portion.

13. A container according to claim 1 wherein the sealing member is provided separately.

14. A container comprising:

a body portion;

a lid portion configured to engage with the body portion;

a locking member mounted on one of the body portion and the lid portion, the locking member being movable from an unlocking position to a locking position in which it engages the other of the body portion and the lid portion to hold the lid in engagement with the body portion; and a sealing member that extends between the locking member and the other of the body portion and the lid portion when the locking member is in its locking position, wherein movement of the locking member from the locking to the unlocking position causes breakage of the sealing member, which is rendered ineffective for further sealing use;

wherein the sealing member extends between the locking member and at least one of the body portion and the lid portion when the locking member is in its locking position by means of apertures provided in the locking member and at least one of the body portion and lid portion.

15. A container comprising:

a body portion;

a lid portion configured to engage with the body portion;

a locking member mounted on one of the body portion and the lid portion, the locking member being movable from an unlocking position to a locking position in which it engages the other of the body portion and the lid portion to hold the lid in engagement with the body portion; and a sealing member that extends between the locking member and the other of the body portion and the lid portion when the locking member is in its locking position, wherein movement of the locking member from the locking to the unlocking position causes breakage of the sealing member, which is rendered ineffective for further sealing use;

wherein the sealing member comprises a pin with a body portion, an arm portion and base portion.

16. A container according to claim 15 wherein the arm portion is joined to the body portion by a frangible connection.

17. A container according to claim 15 wherein the body portion of the sealing member is joined to the base portion of the sealing member by a frangible connection.

18. A container according to claim 17 wherein movement of the locking member from the locking to the unlocking position breaks the frangible connection.

19. A container according to claim 1 wherein the sealing member is made of plastics material.

20. A container according to claim 1 wherein the sealing member is made of material such that movement of the locking member from the locking to the unlocking position is effected by mechanical means.

21. A container according to claim 1 wherein the sealing member is positioned such that it extends between the locking member and another part of the container.

22. A container according to claim 21 wherein the sealing member extends substantially horizontally between the locking member and the other part of the container.

23. A container according to claim 1 wherein the body portion and the lid portion of the container are made of plastics material.

* * * * *